US005173966A

United States Patent [19]

DeLeo

[11] Patent Number: 5,173,966

[45] Date of Patent: Dec. 29, 1992

[54] CODED HEALTH-CARE GLOVE

[76] Inventor: David B. DeLeo, 71 East Ave. Suite Q, Norwalk, Conn. 06851

[21] Appl. No.: 739,084

[22] Filed: Aug. 1, 1991

[51] Int. Cl.[5] ..... A41D 19/00

[52] U.S. Cl. ..... 2/168; 2/169

[58] Field of Search ..... 2/159, 160, 161 R, 163, 2/167, 168, 169, 162; 40/299, 328, 629, 633

[56] References Cited

U.S. PATENT DOCUMENTS

| | | | |
|---|---|---|---|
| 919,406 | 4/1909 | Warren | 2/168 |
| 1,559,114 | 10/1925 | Maranville | 2/161 R X |
| 1,911,500 | 5/1933 | Gowdy et al. | 2/163 |
| 2,451,758 | 10/1948 | Malm | 2/168 |
| 2,581,249 | 1/1952 | Ganz | 2/168 X |
| 3,094,704 | 6/1963 | Abildgaard | 2/168 X |
| 3,633,216 | 1/1972 | Schonholtz | 2/168 |
| 3,852,826 | 12/1974 | Schindler | 2/168 |
| 3,872,515 | 3/1975 | Miner et al. | 2/168 |
| 4,084,265 | 4/1978 | Anfelt | 2/163 |
| 4,218,778 | 8/1980 | Stansbury | 2/168 X |
| 4,884,300 | 12/1989 | Vistins | 2/162 |
| 5,020,160 | 6/1991 | Cano | 2/159 |

FOREIGN PATENT DOCUMENTS

| | | | |
|---|---|---|---|
| 818827 | 10/1951 | Fed. Rep. of Germany | 2/168 |
| 0031926 | 2/1985 | Japan | 2/159 |
| 2144623 | 3/1985 | United Kingdom | 2/169 |
| 2208348 | 3/1989 | United Kingdom | 2/159 |

*Primary Examiner*—Werner H. Schroeder
*Assistant Examiner*—Sara M. Current
*Attorney, Agent, or Firm*—H. Gibner Lehmann; K. Gibner Lehmann

[57] ABSTRACT

A health-care glove constituted of thin elastic rubber-like material and having a thumb at one side edge and a pinkie at the opposite side edge. The glove has distinctive visual indicia for immediately indicating to the user, the location of the thumb thereby to enable him to initially pick up the glove and easily apply it onto his hand with the thumb and pinkie in the proper relative sense.

12 Claims, 1 Drawing Sheet

CODED HEALTH-CARE GLOVE

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field Of The Invention

This invention relates to latex and similar form-fitting gloves, such as surgical gloves, health-care gloves, and the like.

2. Description Of The Related Art Including Information Disclosed Under 37 CFR §§1.97–1.99

Gloves of the type noted above are usually formed by a dipping process, wherein a hand-shaped form of glass or other suitable material is dipped in a latex solution which adheres to the form in a thin layer that quickly air cures and can then be stripped off, essentially as the final product. Many of the gloves are typically ambidextrous, that is, they fit similarly on either hand. The glove formation is characterized by the thumb and pinkie fingers being at opposite sides, and because of this the user, by virtue of a casual glance, mistakes one finger for the other, with the result that the glove either ends up being put on backwards or else presents difficulty in being applied. This also results in a loss of time and convenience.

SUMMARY OF THE INVENTION

The above disadvantages and drawbacks of prior form-fitting gloves are largely overcome by the present invention, which has for one object the provision of an improved rubber-like glove and method for producing the same, by which there is obviated the confusion presently existing with conventional gloves in recognizing easily and quickly the thumb and pinkie fingers at the time that the glove is picked up for use.

Another object of the invention is to provide an improved glove and method for making the same as above set forth, which are simple, easy to produce and carry out, and inexpensive.

A further object of the invention is to provide a rubber-type glove as characterized above, wherein simple means are provided to designate the thumb or pinkie and to distinguish the same easily and quickly from the other side finger of the glove.

In accomplishing the above objects the invention provides a health-care glove constituted of thin elastic rubber-like material, having a thumb at one side edge, a pinkie at the opposite side edge, and having three fingers disposed intermediate the thumb and pinkie. While the thumb and pinkie might initially appear to present a similar and confusing appearance when casually viewed, the glove of the invention is provided with distinctive, visible indicia means for quickly and unmistakably indicating to the user the location of the thumb or pinkie.

The objects are further accomplished by a pair of either ambidextrous or else left-and right-hand health-care gloves constituted of thin elastic rubber-like material, the gloves each having a thumb at one side edge and a pinkie at the opposite side edge, and each having three fingers disposed intermediate the respective thumbs and pinkies. The gloves are provided with distinctive, visible indicia means for quickly and unmistakably indicating to the user the location of the thumbs, and the indicia on one glove differ from the indicia on the other glove, so as to enable the user to readily distinguish the thumbs and the pinkies.

The objects are still further accomplished by a method of making a health-care glove, which includes the steps of dipping a hand-shaped form into a bath of rubber-like liquid to form a coating thereon, allowing the coating to become more viscous, thereafter coating the thumb of the coated form with a contrasting rubber-like liquid, and then stripping the glove formed thereby from the hand-shaped form.

Other objects and advantages of the invention will hereinafter appear.

DESCRIPTION OF THE PREFERRED EMBODIMENTS

Figures 1, 2, 9:
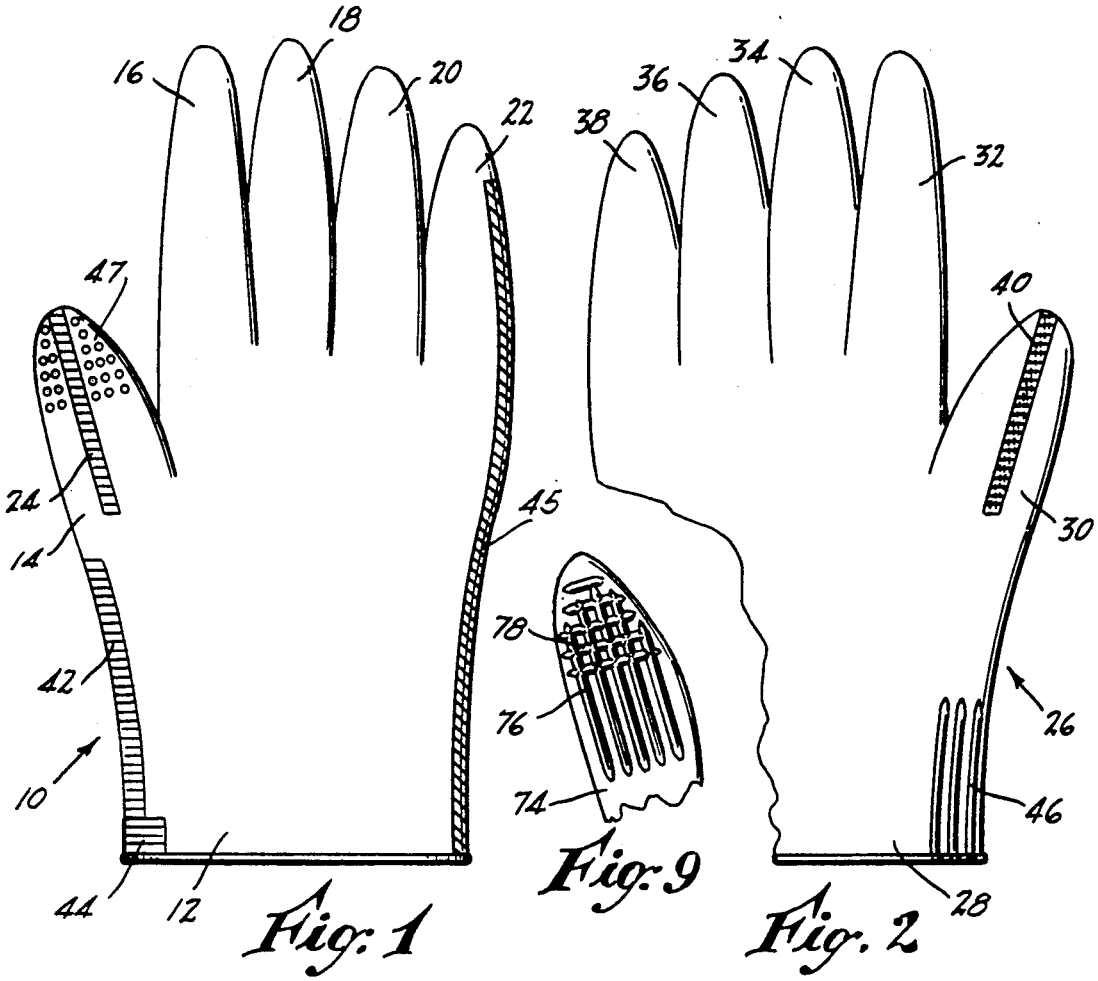
FIG. 1 is a palm plan view of a health-care glove showing several embodiments as provided by the invention.
FIG. 2 is a palm plan view, partially broken away, of a health-care glove illustrating another embodiment of the invention.
FIG. 9 is a fragmentary elevational view of a left-hand thumb of a glove, showing yet other embodiments of the invention.

Referring now to the figures, the glove 10 illustrated in FIG. 1 is constituted of transparent or translucent latex or other rubber-like material, and comprises a wrist portion 12, thumb 14, index finger 16, middle finger 18, fourth finger 20 and pinkie 22. It will be noted that the thumb 14 is at one side edge of the glove, and that the pinkie 22 is at the other side edge of the glove.

In accordance with the present invention, on the inside of the thumb 14 a blue or other colored stripe 24 is provided, such a stripe being visible from the exterior because of the thinness of the glove and the transparency or translucency of the latex material. Referring now to FIG. 2 there is shown a right-handed glove 26 having a wrist portion 28, thumb 30, index finger 32, middle finger 34, fourth finger 36 and pinkie 38. On the inside of the thumb 30 there is provided in accordance with the invention, a colored stripe 40 of gold, yellow or other coloring, which also is visible from the exterior.

It will now be apparent that when a user picks up the gloves 10 and 26 and prepares to don them, he or she will be able to tell with even a casual glance, which hand is which and also where the thumbs are.

The different colors quickly identify either the left or right-hand and also designate which fingers are the thumbs.

The stripes 24 and 40 can be imprinted on the thumbs prior to the gloves being stripped off of the forms whereby they will be located on the insides as the gloves become reversed by the stripping-off operation.

FIG. 1 also illustrates another embodiment of the invention. The wrist portion 12 has on its inside a colored stripe 42, for example, blue, which extends up to the base of the thumb 14. The stripe 42 will also be a good indication of the location of the thumb 14. The stripe 42 can be imprinted on the latex while the glove is still on the dipping form, whereby it ends up on the inside, just as the stripe 24 did.

FIG. 1 further illustrates the use of a self-stick or pressure-sensitive label 44 which could be applied to the wrist portion 12 of the glove 10 to indicate in a more general manner the location of the thumb 14.

The showing of FIG. 1 reveals still other embodiments of the invention. The pinkie side edge of the glove could be provided with a contrasting color stripe 45, shown as being green in color, although red or other colors could serve as well. Additionally, the thumb 14 could have a plurality of raised dots or nibs 47, produced by a like configuration in the hand form from which the glove is made by dipping. The use of the dots 47 would not require any secondary operations, and thus the cost of the glove would not be increased in any way.

In FIG. 2 the wrist portion 28 of the glove 26 could be provided with a rib formation 46 in the latex, to designate the side edge of the glove which has the thumb 30. The rib formation would result from a similar configuration provided on the surface of the hand form, with which the glove is made.

Figure 3:
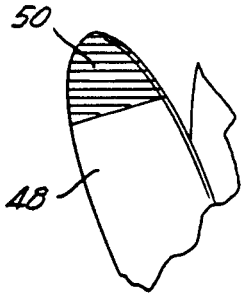
FIG. 3 is a fragmentary view of the thumb of a left-hand glove, showing yet another embodiment of the invention.
Figure 4:
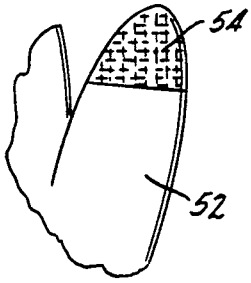
FIG. 4 is a fragmentary view of the thumb of a right-hand glove, illustrating still another embodiment of the invention.

FIG. 3 shows a left thumb 48 which has, for example, a blue tip 50 formed by inside coloring, and FIG. 4 shows a right thumb 52 which has a golden-colored tip 54 produced by inside coloring.

Figure 5:
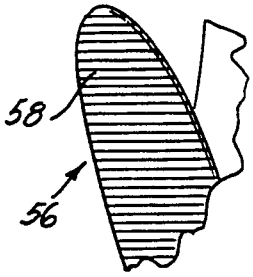
FIG. 5 is a fragmentary view of the thumb of a left-hand glove, depicting still another embodiment of the invention.

FIG. 5 illustrates a left thumb 56 which is completely colored, for example blue, by coloring 58 applied on its inside.

Figure 6:
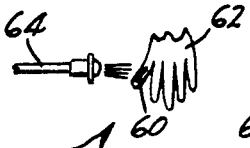
FIG. 6 is a diagrammatic representation showing a hand-shaped form with a latex coating having a colored latex strip sprayed onto its thumb.

FIG. 6 shows a latex stripe 60 which is sprayed onto the thumb of an already latex coated glass hand-form 62 by a jet sprayer 64 after the initial latex coating has been allowed to slightly cure. This spraying is done after the form was first dipped into the latex bath. The stripe 60 can integrate with the existing latex film as the form 62 is withdrawn from the bath.

Figure 7:
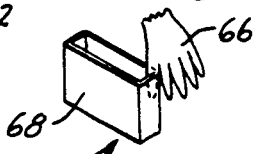
FIG. 7 is a diagrammatic representation showing a hand-shaped form with latex coating, having the thumb only being dipped in a colored latex bath to apply a coloring.

FIG. 7 illustrates a hand-form 66 having its thumb dipped into a colored latex bath 68 after the initial coating of the form by latex. The coated form 66 is allowed to slightly air cure prior to its thumb being immersed in the colored latex bath to produce the coloring.

Figure 8:
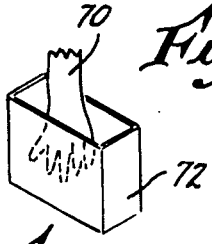
FIG. 8 is a diagrammatic representation of a hand-shaped form being dipped into a latex bath.

FIG. 8 shows the usual immersion of a hand form 70 in a latex bath 72.

FIG. 9 illustrates still other embodiments of the invention wherein a right thumb 74 is provided with a rib formation 76 which is easily distinguishable by even a casual glance, to enable the thumb to be quickly identified so as to facilitate donning of the glove. The tip formation of the thumb also has a cross-rib or grid-like configuration 78 to distinguish the thumb. The configurations 76 and 78 result from the providing of suitable surface configurations in the hand form which is dipped in the latex bath, and it will be noted that this type of indicia does not involve any secondary operations, whereby the cost of manufacture is not increased at all.

It will now be seen from the foregoing that I have provided an improved health-care glove and method of making the same by the use of latex or similar material, wherein indicia means is provided at a side edge of the glove to apprise a user of the location of the thumb, thereby to facilitate the donning of the glove. Certain of the measures illustrated herein, as for example the ribbing configurations shown in FIGS. 2 and 9 can be carried out without any additional expense whatsoever in the fabricating procedure.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A health-care glove constituted of thin elastic rubber-like material, said glove having inner and outer surfaces, and having a thumb member and a pinkie member at opposite side edges of the glove, and having three fingers disposed intermediate the thumb member and pinkie member, said thumb member and pinkie member normally presenting a similar and confusing appearance when casually viewed, and said glove being provided with distinctive, visible indicia means for quickly and unmistakably indicating to the user the location of a predetermined one of said members at one of the side edges of the glove, said indicia means comprising back-to-back, complementary inner and outer surface undulations on the inner and outer surfaces at said one of the side edges of said glove.

2. A glove as set forth in claim 1, wherein said colored material comprises a colored stripe disposed on the inner surface of the said one member.

3. A glove as set forth in claim 1, wherein said colored material is disposed on the inner surface of the tip of the said one member.

4. A glove as set forth in claim 1, wherein said colored material is disposed on the entire inner surface of the said one member.

5. A glove as set forth in claim 1, wherein said undulations comprise raised portions.

6. A glove as set forth in claim 1, wherein said undulations comprise raised ribs.

7. A glove as set forth in claim 1, wherein said undulations comprise spaced-apart raised ribs.

8. A glove as set forth in claim 1, wherein said undulations comprise a grid-like configuration.

9. A glove as set forth in claim 1, wherein said undulations are disposed on said one predetermined member.

10. A health-care glove having an inner and an outer surface, said glove being constituted of thin elastic rubber-like material, said glove having a thumb member and a pinkie member at opposite side edges of the glove, and having three fingers disposed intermediate the thumb member and pinkie member, said thumb member and pinkie member normally presenting a similar and confusing appearance when casually viewed, and said glove being provided with distinctive, visible indicia means disposed at one of the side edges of the glove, for quickly and unmistakeably indicating to the user the location of a predetermined one of said members, said indicia means comprising colored material disposed on the inner surface of the said glove.

11. The method of making a health-care glove having five fingers and having identifying indicia along a side edge of the glove, which includes the steps of dipping a hand-shaped form having one side edge which includes a thumb portion and another side edge which includes a pinkie portion, and having three finger configurations disposed intermediate the thumb portion and pinkie portion, said form having one of said side edges provided with a textured surface configuration comprising undulations, which includes the steps of:

a) dipping the form into a bath of rubber-like liquid to form a coating thereon and lifting the form out of the bath, thereby to impart, to one of the side edges of the glove which is formed by said textured side edge of the form, a similar textured configuration comprising corresponding undulations on both the inner and outer surfaces of the said one side edge of the glove, said glove having a thumb member and a pinkie member, b) allowing the rubber-like liquid on the dipped form to cure, and c) thereafter stripping the glove from the dipped form, all to the end that the said textured configuration of the glove side edge is located adjacent one of said members and can be readily observed, thereby to quickly enable a user to identify either the thumb member or else the pinkie member of the glove.

12. The method as set forth in claim 11, wherein:

a) the step of dipping the form and lifting the form comprises imparting directly to one of said members of the glove, the said textured configuration.

* * * * *